US006997417B2

(12) United States Patent
Zarkades

(10) Patent No.: US 6,997,417 B2
(45) Date of Patent: Feb. 14, 2006

(54) APPARATUS FOR CONTROLLING TRAFFIC FLOW ALONG A PATHWAY

(76) Inventor: Nicholas Zarkades, 88 Boyles St., Beverly, MA (US) 01915

( * ) Notice: Subject to any disclaimer, the term of this patent is extended or adjusted under 35 U.S.C. 154(b) by 0 days.

(21) Appl. No.: 10/750,172

(22) Filed: Dec. 31, 2003

(65) Prior Publication Data

US 2005/0139730 A1 Jun. 30, 2005

(51) Int. Cl.
*B61L 29/00* (2006.01)

(52) U.S. Cl. ..... 246/125; 246/127; 246/473.1; 49/49; 49/124

(58) Field of Classification Search ..... 246/127, 246/473.1, 125; 49/49, 124; 219/520, 521, 219/201

See application file for complete search history.

(56) References Cited

U.S. PATENT DOCUMENTS

| | | | | |
|---|---|---|---|---|
| 441,226 | A | 11/1890 | Blethen et al. | |
| 494,390 | A * | 3/1893 | Smith | 49/124 |
| 827,772 | A * | 8/1906 | Worland | 246/263 |
| 3,852,570 | A * | 12/1974 | Tyler | 219/528 |
| 4,666,108 | A | 5/1987 | Fox | |
| 4,792,659 | A * | 12/1988 | Thomas | 219/201 |
| 5,118,056 | A | 6/1992 | Jeanise | |
| 5,603,856 | A * | 2/1997 | Bischoff | 219/202 |
| 5,669,588 | A | 9/1997 | Goldsmith | |
| 6,189,839 | B1 | 2/2001 | Lemieux | |
| 6,194,685 | B1 * | 2/2001 | Rutherford | 219/201 |
| D439,168 | S | 3/2001 | Hickman | |
| 6,212,825 | B1 | 4/2001 | Hopkins, Jr. | |
| 6,267,332 | B1 | 7/2001 | Almblad | |
| 6,397,701 | B1 | 6/2002 | Park | |
| 6,618,993 | B1 | 9/2003 | Burke | |
| 2002/0129552 | A1 * | 9/2002 | Burke | 49/49 |

* cited by examiner

*Primary Examiner*—Mark T. Le
(74) *Attorney, Agent, or Firm*—George A. Herbster

(57) ABSTRACT

A railroad crossing gate with a gate assembly. An extendible member slides within an outer member with minimal friction. When the gate is in its open position, gravity retracts the extendible member to hollow member. When the gate is in its blocking position, gravity causes the extendible member to move out of the hollow member to a final blocking position.

24 Claims, 5 Drawing Sheets

APPARATUS FOR CONTROLLING TRAFFIC FLOW ALONG A PATHWAY

BACKGROUND OF THE INVENTION

1. Field of the Invention

This invention generally relates to devices for blocking the flow of traffic along a traffic pathway and more specifically to gates that control automotive flow at a highway railroad crossing.

2. Description of Related Art

Efforts are being made to improve safety at railroad gate crossings. The purpose is to prevent collisions between trains and automotive vehicles. Conventional crossing gates comprise two crossing gate assemblies. One gate is positioned on each side of the railroad crossing. When the gate is in a blocking position it blocks only the approach lane or lanes of a highway, not the exit lanes. So it is possible for a person to cross the tracks with the gates in their blocking positions.

More recently it has been suggested to use four crossing gates. A pair of gates are positioned on each side of the highway. One gate closes the approach lane and the other the exit lane. As a result the gates on the opposite sides of the highway provide a substantially continuous barrier. This approach is effective, but it also is expensive because it requires twice the number of gates with all their structures and costs and twice the maintenance. Further, upgrading existing crossings still require a significant effort in routing utilities either across the highway or beneath the tracks in order to control the operation of the two additional gates. Consequently many railroad crossings continue to be guarded by two gates that only block the approach lanes.

Other approaches for improving railroad crossing gates have been suggested. One initially obvious and simple approach would appear to be merely extending the length of the crossing gate so it extends completely across a highway in a blocking position. In many situations, however, this is not possible because the position of the gate in an open, or vertical, position may interfere with trees, power lines or other structures proximate the crossing gate location. Moreover, such an elongated gate must be constructed with sufficient strength to withstand environmental and other factors.

It has been proposed to use "extendible" gates. An extendible gate generally has a rotatable arm that swings between open and blocking positions and that carries an extendible member. Some operating mechanism extends and retracts the member as the rotatable arm moves between blocking and open positions. U.S. Pat. No. 441,226 depicts one such extendible gate in which a first section can tilt freely from a vertical, or open, position to a horizontal, or blocking, position and carries a movable section. The operating mechanism comprises a ramp or inclined way frame and a pendulum-like device. The pendulum-like-device includes a wheel that rides on the way frame and a weighted rod that engages the movable section. When the first section tilts to a blocking position, the wheel and rod move down the ramp and extend the arm.

In U.S. Pat. No. 494,390 the operating mechanism comprises a pulley that connects to a swing arm proximate a base. The pulley has a pinion attached to a fixed segment gear. An endless band connects to an inner end of an extendible arm and wraps around the pulley. As the swinging arm rotates, the pulley rotates relative to the swing arm, and the cable extends or retracts the extendible arm.

U.S. Pat. No. 4,666,108 discloses a railroad crossing gate with a first rotatable member that carries a telescoping member. However, the extension merely allows adjustment of the overall length of the crossing gate to be determined at an installation site. The telescoping member does not move relative to the first rotatable member after installation.

U.S. Pat. No. 6,212,825 is an example of a gate with a motor driven operating mechanism. The mechanism rotates the secondary gate between extended and retracted positions with respect to a primary gate. The motor drive attaches to the free end of the primary gate.

U.S. Pat. Nos. 6,618,993 and 6,267,332 depict railroad grade crossing systems in which a motor drives an extendible member between extended and retracted positions for purposes of completely closing vehicle access to a railroad crossing.

The foregoing patents disclose operating mechanisms of different implementations. However, they all require increased maintenance. Each operating mechanism is subject to wear and vandalism. The motor-driven railroad crossing gates are more expensive to manufacture and still require further maintenance.

In addition, it is estimated that there are many thousands of railroad grade crossings that need to be upgraded allowing a single crossing gate to block both the approach and exit lanes of one side of the grade crossing. It might appear that these operating mechanisms theoretically could be used for such upgrades. However, each of the foregoing operating mechanisms has inherent complexities and costs that will make the use of such operating mechanism unattractive for retrofitting.

SUMMARY

Therefore it is an object of this invention to provide and extendible gate for blocking traffic flow across an entire traffic pathway.

Another object of this invention is to provide an extendible gate that is reliable and economical to construct.

Another object of this invention is to provide a railroad crossing gate that blocks traffic at both the approach and exit lanes of a highway.

Yet another object of this invention is to provide a railroad crossing gate that is economical to manufacture.

Still another object of this invention is to provide a railroad crossing gate that is reliable and requires minimal maintenance.

Yet still another object of this invention is to provide a railroad crossing gate that can retrofit to upgrade existing crossing gates.

In accordance with one aspect of this invention a gate attaches to a base unit mounted adjacent a traffic path to block traffic flow along the traffic pathway. The gate has a first hollow member affixed to the base for limited rotation between open and blocking positions. A second member is slidable in the first hollow member for a displacement distance along an extension axis. A stop member internally of the first hollow member defines the limits of the displacement distance. In the open position the second member nests in the first hollow member. In the blocking position the second member extends from the first hollow member to a position determined by the stop member thereby to block a traffic pathway.

In accordance with another aspect of this invention a railroad crossing gate for blocking a highway comprises a base unit and a gate. The base unit mounts in the ground adjacent a highway and has a source of electrical power, a rotatable arm and an electrically-operated motor for rotating the arm between an open position and a blocking position. The gate includes a hollow member having a first end affixed to the arm whereby the hollow member rotates between the open and blocking positions with the arm. An extendible member is slidable within the hollow member from an inner position to an outer position relative to the hollow member along an extension axis. A stop defines the outer position of the extendible member whereby in the open position the extendible member nests in the hollow member and in the blocking position the extendible member extends from the hollow member to an outer position thereby to block traffic on the highway from the railroad crossing.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
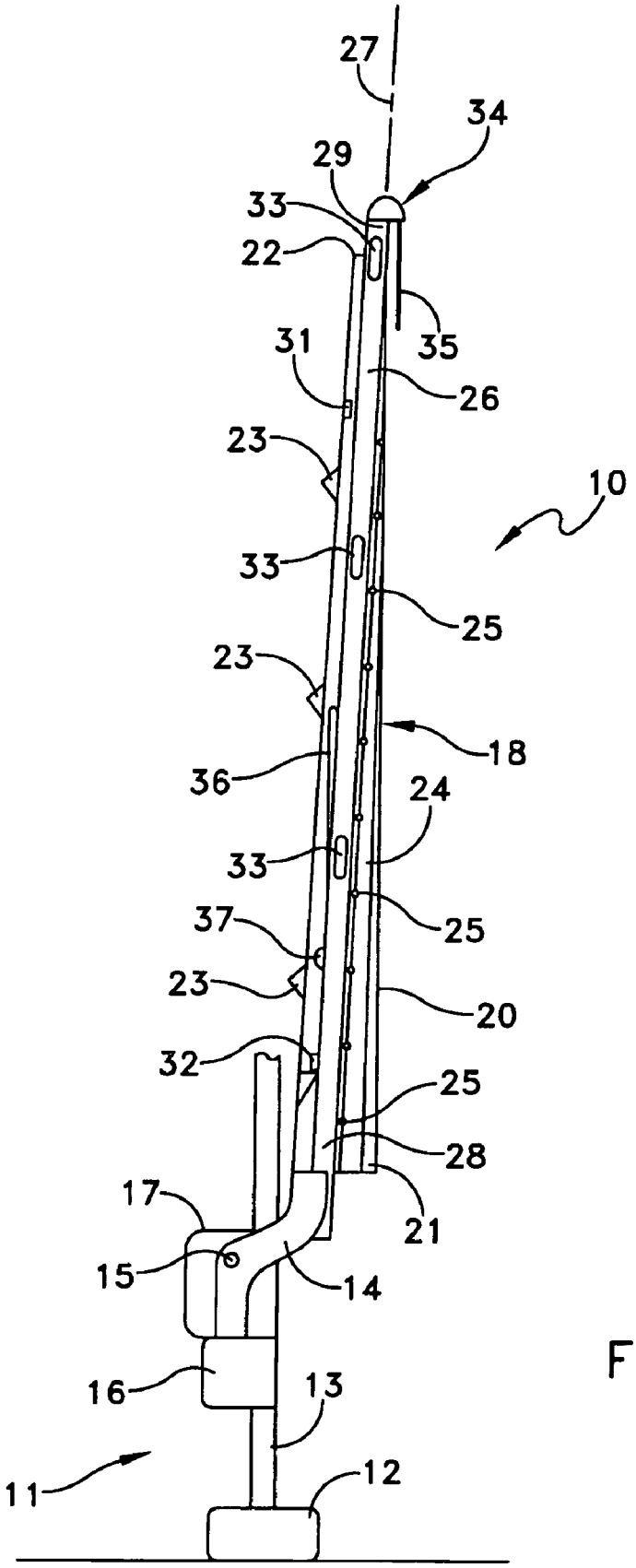
FIG. 1 depicts a railroad crossing gate constructed in accordance with this invention in an open position.
Figure 2:
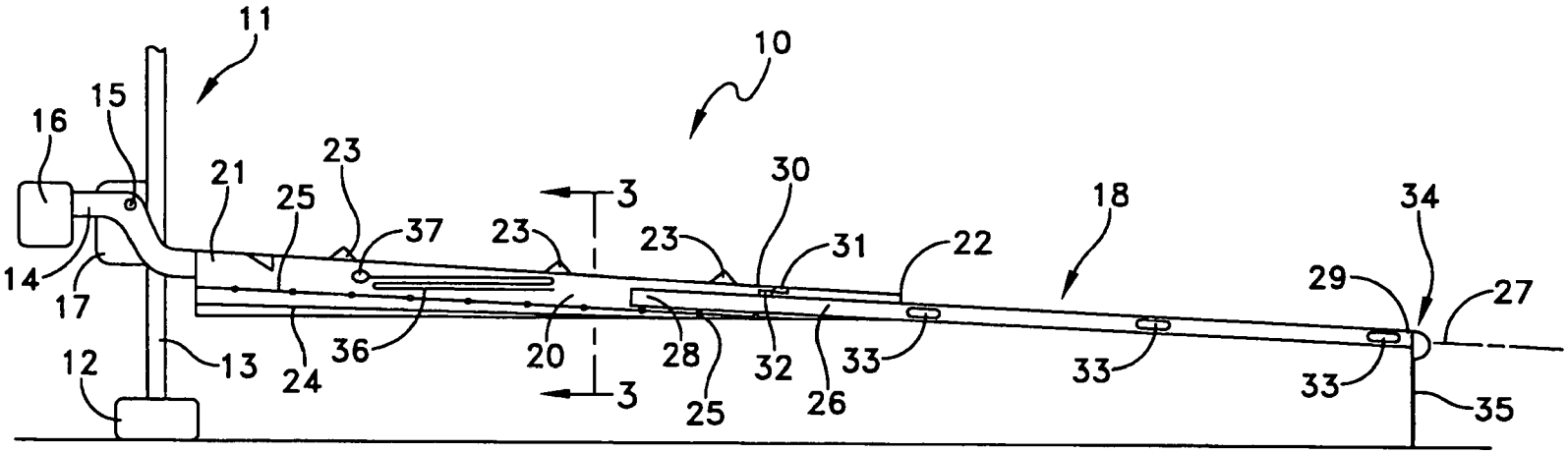
FIG. 2 depicts the crossing gate of FIG. 1 in a blocking position.
Figure 3:
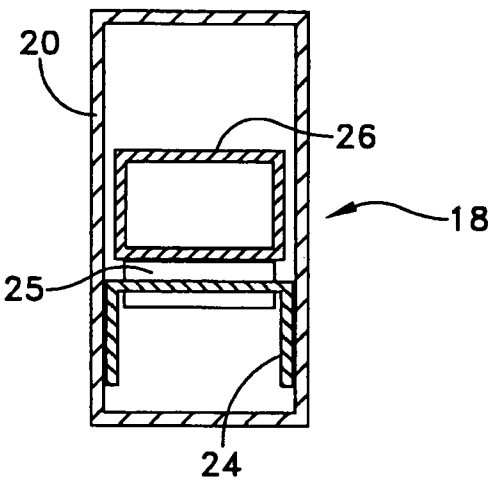
FIG. 3 is a cross-section taken along lines 3—3 in FIG. 2.

Referring to FIGS. 1 through 3, a first embodiment of a crossing gate 10 includes a base unit 11 with a base or footing 12 generally buried in the ground. A post 13 extends vertically from the footing 12 and carries a rotatable arm 14 mounted on a pivot 15 with a counterweight 16. An enclosed motor drive 17 moves the arm 14 between an open position shown in FIG. 1 and a closed position shown in FIG. 2. Such base units 11 are well-known in the art and are particularly adapted for being retrofitted by a gate constructed in accordance with this invention.

The arm 14 carries a gate 18 constructed in accordance with this invention. In FIGS. 1 through 3, the gate 18 includes a first hollow member 20 with a first an end 21 affixed to the arm 14. A second end 22 typically will be displaced from the first end 21 so the overall length of the first member will be approximately one-half the width of a grade crossing. That is, in the blocking position shown in FIG. 2, the first member 20 essentially blocks an approach lane. As shown in FIG. 3, the first member 20 is formed as a hollow tapered rectilinear structure. Such structures are readily produced by extrusion of a carbon-filled fiberglass or like light-weight, strong, rigid material.

The hollow member 20 carries a number of lights 23 spaced along its exterior in accordance with conventional requirements. The connection of such lights to an electrical power source in the base unit 11 is well-known to those skilled in the art and is not shown in this disclosure.

The hollow member 20 also carries a tapered or inclined ramp 24 having a maximum thickness at the end 21. The inclined ramp carries a plurality of spaced bearings 25 on which an extendible arm 26 can be displaced along an extension axis 27. The extendible arm 26 has an inner end 28 and an outer end 29 and is preferably formed of an extruded aluminum or like material. When the hollow member 20 is in a blocking position, the extension axis 27 inclines downwardly from the arm 14 toward the outer end 29.

The hollow member 20 and extendible arm 26 operate with stop 30 (FIG. 2) that defines the limit of outward displacement of the extendible arm 26. As shown specifically in FIGS. 1 and 2, a first stop element 31 attaches to the interior surface of the hollow member 20 and a second stop element 32 attaches to the outer surface of the extendible arm 26.

The extendible arm 26 also includes a plurality of embedded lights 33 axially spaced along the length of the extendible arm 26. These would also be connected in parallel with lights 23. Specific connections are not shown because they are well known to persons of ordinary skill in the art.

The end 29 of the extendible arm 26 carries an end structure 34 that includes a pivoted leg or lifter 35. When the extendible arm 26 is in the blocking position, the lifter 35 pivots to a position shown in FIG. 2 thereby to provide outboard support for the gate 18 by engaging the ground.

FIGS. 1 and 2 also depict an optional heating unit 36 with a thermostat 37 that is useful in colder climates to prevent any buildup of ice within the structure that could block the operation or could inhibit the sliding operation.

In FIG. 1 the gate 18 is an open position such that the extension axis 27 is near vertical. In this orientation, gravity retracts the extendible arm 26 into the hollow member 20. Consequently the overall length corresponds to the overall length of a conventional crossing gate and should not interfere with any surrounding structures.

When the drive 17 unit rotates the arm 14 and gate 18 clockwise to the substantially horizontal position shown in FIG. 2, the extension axis 27 will, as a result of the ramp structure 24, attain a downward and outward slope (i.e., to the right in FIG. 2). When gravity acts on the extendible arm 26 and overcomes any sliding friction between the extendible arm 26 and the hollow member 20, the extendible arm 26 moves to the right as shown in FIG. 2 to close the opposite lane of traffic. As will be apparent, the use of the bearing assemblies 25 minimizes the frictional force so displacement of the extendible arm 26 occurs at a very slight downward orientation of the extension axis 27. The weight of the extendible arm 26 can also be adjusted by a selection of materials or extrusion web thickness to optimize this outward movement under gravity. Also, the extendible arm 26 shifts to the right as shown in FIG. 2 until the stop element 32 engages the stop element 31. As will also be apparent, if adjustments in the overall length of the extended gate 13 are required, it is an easy procedure during installation to position the stop element 32 at an appropriate location along the length of the extendible arm 26. That is to shorten the extension, the stop member 32 could be moved toward the end 29.

After a train passes, the arm 14 rotates the gate 18 to the position shown in FIG. 1. Eventually the extension axis 27 will slope down to the end 21. When a sufficient slope exists, gravity returns the extendible arm 26 into its nested position within the hollow member 20. Thus in accordance with this invention, all the motion of the extendible arm 26 occurs as a result of gravity acting on the extendible arm 26. Only the structure 24 is added to the hollow member 20, and the structure 24 is relatively maintenance free and, in cold climates, can be assured of operation through a heating system such as represented by the heating coil 36.

Figure 4A:
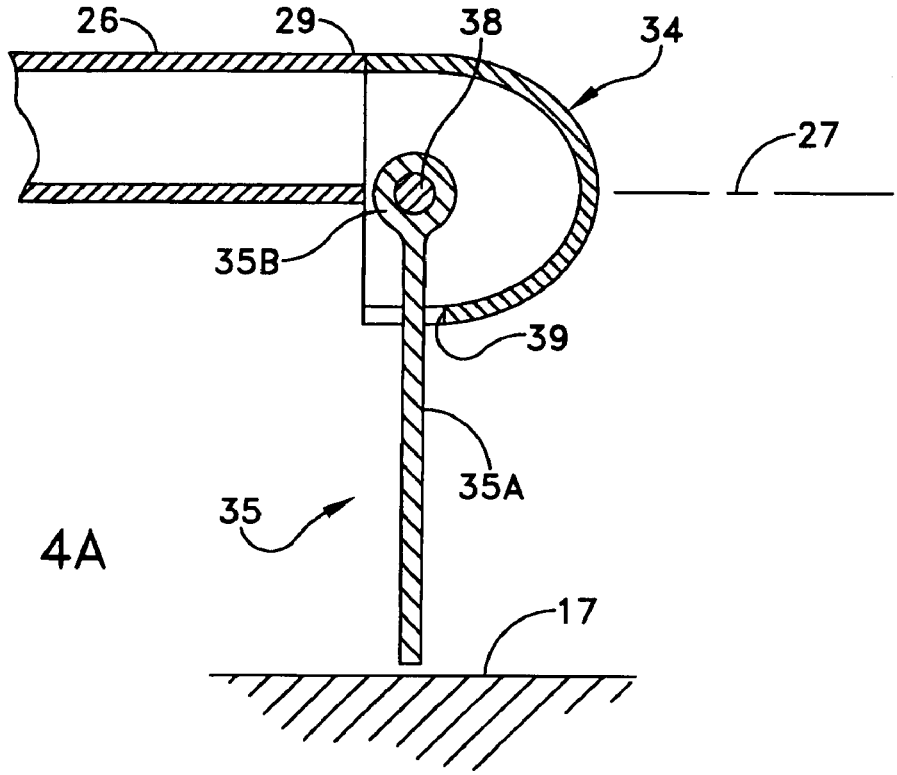
FIGS. 4A and 4B depict an end structure useful in connection with the crossing gate of FIGS. 1 and 2.
Figure 4B:
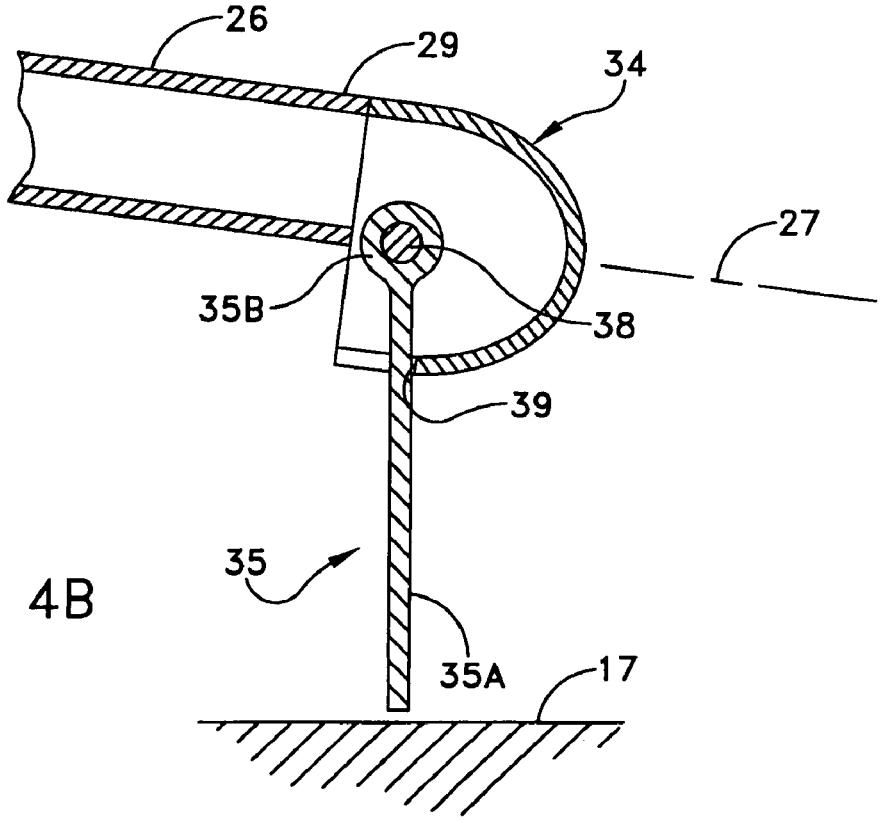
Figure 5:
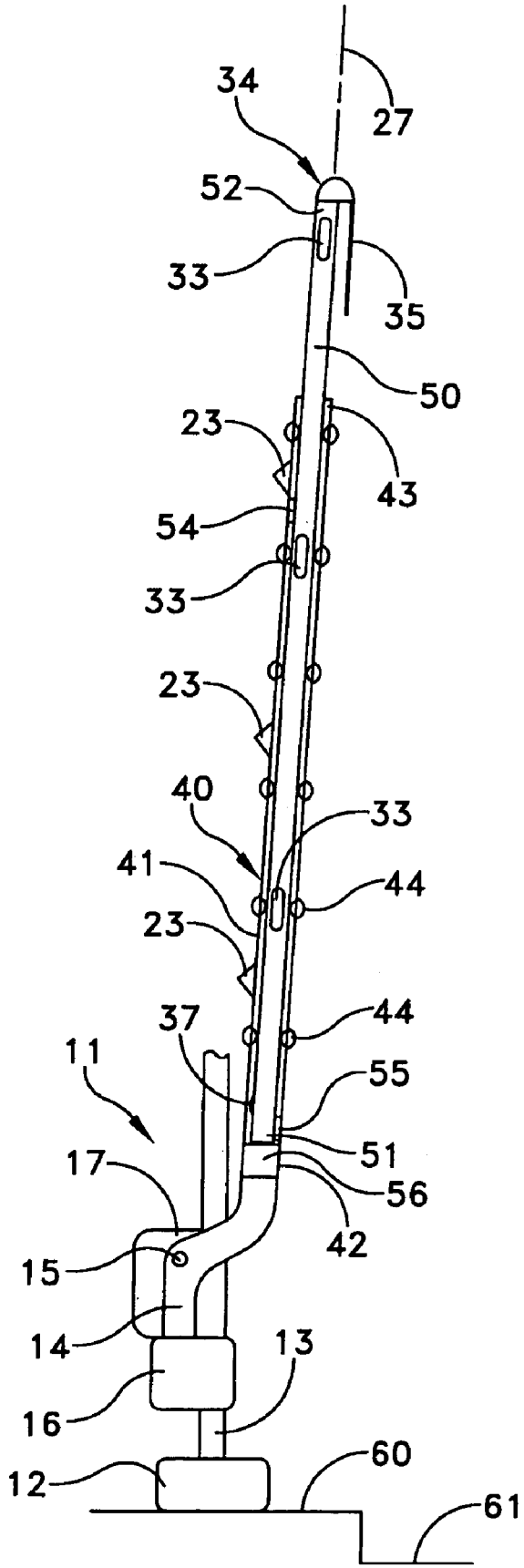
FIG. 5 is a view of another embodiment of railroad crossing gate in an open position.

FIGS. 4A and 4B more clearly define the operation of the lifter 35 in conjunction with the end structure 34. More specifically the end structure 34 includes a pivot 38 and a stop 39. The lifter 35 includes a leg portion 35A and a saddle 35B that mounts on the pivot 38. When the gate 18 reaches a horizontal position, the lifter 35 moves to a vertical position that is spaced so that the leg 35A is spaced from the stop 39. A slight additional rotation of the extendible arm 26 to the position shown in FIG. 4B causes the leg 35A to abut the stop 39. In this position, however, the leg is an over center-position relative to the extension axis 27 so that in contacting the ground 17 the lifter 35 remains in a stable position. When the gate 18 returns to the open position, the lifter 35 pivots away from the stop 39 to the position shown in FIG. 1.

FIGS. 5 through 8 depict an alternative embodiment of this invention and like reference numerals refer to like elements throughout. As shown particularly in FIGS. 5 and 6, a gate 40 connects to the arm 14 of a base unit 11 that is identical to the base unit 11 in FIG. 1. The gate 40 includes a constant diameter tubular member 41 with one end 42 attached to the arm 14 and the other end 43 constituting a free end. Lights 23 attach to the outside of the tubular member 41. The tubular member 41 also carries a plurality of axially-spaced bearing sets 44. As shown particularly in FIG. 7, in this particular embodiment a bearing set 44 comprises four bearing receptacles 45 angularly spaced about the tubular member 41 each carrying a rotatable bearing 46 on a bearing axis 47 that is perpendicular to an extension axis 27.

An extendible arm 50 also formed as a cylinder has an inner end 51 and an outer end 52. The extendible arm 50 carries embedded lights 33 like those shown in FIGS. 1 and 2. The end 52 supports an end cap 34 and lifter 35 that operate in the same manner as shown with respect to FIGS. 4A and 4B.

Figure 8:
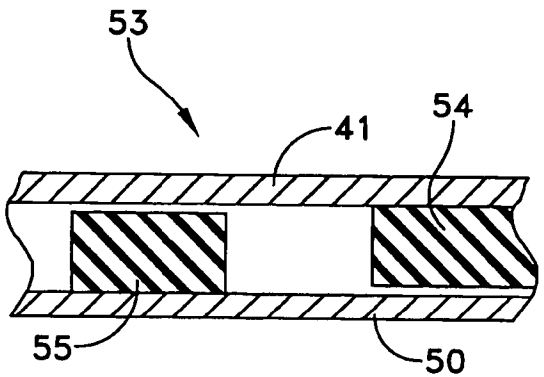
FIG. 8 is an enlarged portion of a stop member structure as shown in FIG. 5.
Figure 7:
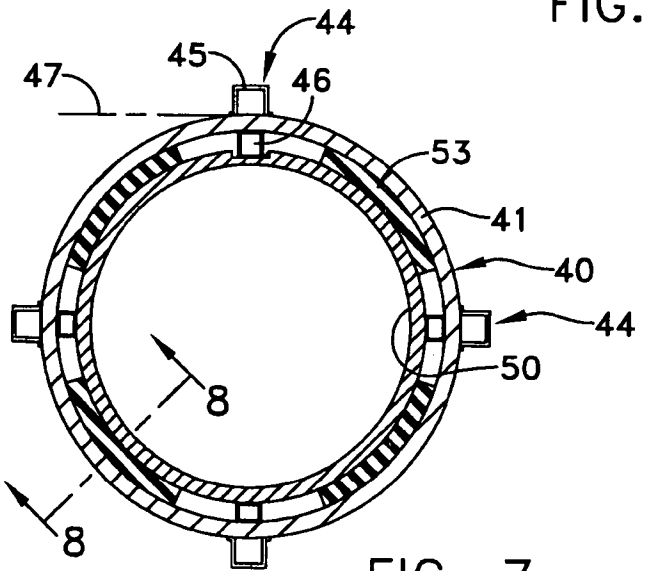
FIG. 7 is a cross-section taken along lines 6—6 in FIG. 5.

The gate 40 also includes a stop 53. Referring particularly to FIG. 8, the stop includes two stop elements. A first stop element 54 is affixed to the tubular member 41. The extendible member 50 carries a second stop element 55. As the extendible arm 50 extends from the tubular member 41, the distance between the elements 54 and 55 closes until they abut. This limits that portion of the extendible arm 50 that cantilevers from the tubular member 40. Typically, however, the stop element 55 is positioned axially so that the inner portion of the extendible arm 50 is proximate the end 51 spans at least two bearing sets 43 to assure that the extendible arm 50 remains on the extension axis 27.

Figure 6:
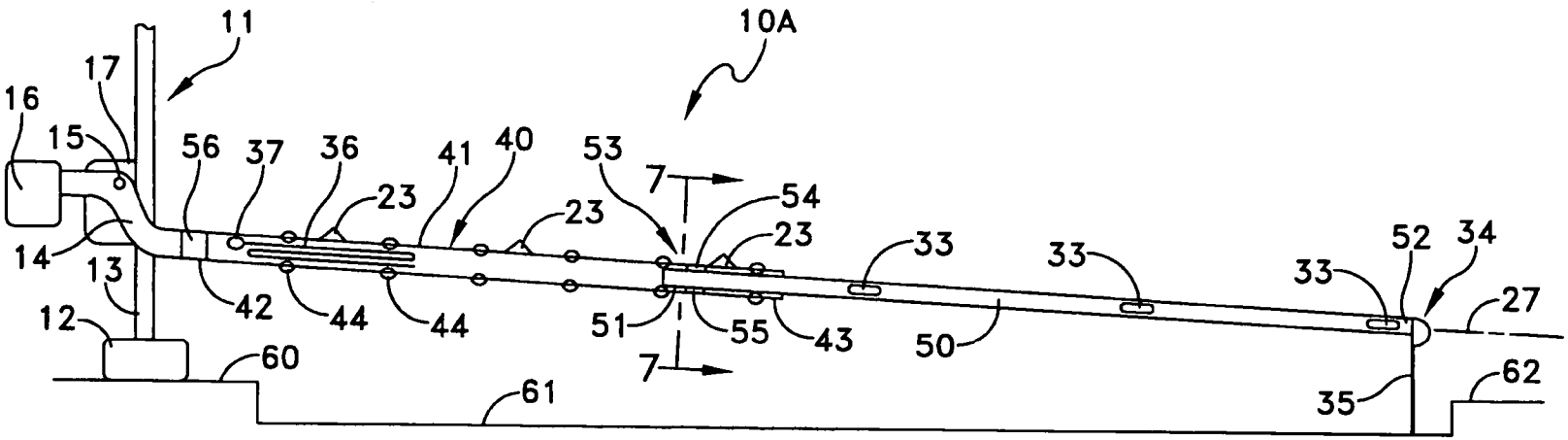
FIG. 6 depicts the railroad crossing gate shown in FIG. 4 in a blocking position.

FIG. 6 also depicts a bumper 56 located at the end 42 of the tubular member 41. The bumper 56 absorbs any impact caused when the extendible arm 50 retracts into the hollow member 40.

The hollow member 40 can also include a heater 36 and thermostat 37 that would operate in the same manner as that shown with respect to the embodiment of FIGS. 1 through 4.

The operation of the gate 40 is basically the same as is the operation of the gate 18 in FIG. 1. FIG. 6 depicts the base unit 11 at a curb portion 60, an intermediate roadway 61 and an opposite curb portion 62. In the vertical or open position gravity retracts the extendible arm 50 into the hollow member 40 with the end 51 against the bumper 56. As in the first embodiment, the overall vertical height of the gate 40 is approximately the same as the gate 18 in FIG. 1; that is, the height of the gate 40 is about one-half the extended length.

To move the gate to a blocking position, the drive 17 rotates the arm 14 until the extension axis 27 is slightly depressed or inclined downwardly from the end 51 to the end 52. At some small slope, gravity acting on the extendible arm 50 overcomes any sliding friction, so the extendible arm 50 shifts until stop elements, such as the stop element 55 shown in FIG. 8 abut stop elements, such as the stop element 54. As the gate 40 lowers to a blocking position, the lifter 35 extends to its over center position and engages the curb 62. Thus in the extended position, the gate 40 blocks both the approach and exit lanes on one side of the railroad tracks. When the gate 40 opens, the drive 17 rotates the arm 14. As the extension axis 27 rotates above the horizontal, gravity causes the extendible arm 50 to slide back toward the end 42 against the bumper 56 so the gate 40 is in its compact configuration when it is vertical. Consequently retrofitting two existing railroad crossing gates 10 by substituting either a gate 18 or a gate 40, upgrades the crossing because each gate fully blocks the roadway on one side of the tracks.

Thus in accordance with this invention a gate is readily adapted for connection to base units at railroad crossings. In an open position the gate has about one-half the length of its length in a blocking position. The gates are readily adapted for upgrading existing crossings by a simple retrofitting process. This process involves removing the existing gate and rewiring the gate foot for lights and heating elements, if needed.

Another advantage of this invention lies in the fact that different highways have different widths. If a full extension of either of the extendible arms 26 or 50 is not necessary, it is a simple matter during installation to relocate the stop element, such as the stop element 32 in FIG. 2 or the stop element 55 in FIG. 8 to control the amount of extension by moving the corresponding stop member toward the end structure 34.

As will now be apparent, a railroad crossing gate constructed in accordance with this invention meets the various objectives of this invention. The crossing gate provides full blocking across both approach and exit lanes at a railroad crossing. Extruded parts of various lightweight and strong materials make it possible to construct such a railroad crossing gate with minimal expense. The structure is readily used to replace existing crossing gates that only block an approach lane to a railroad crossing. The operation is reliable because the only moving force is the force of gravity.

This invention has been described with some specific materials such as carbon-filled fiber, fiberglass for hollow members and aluminum for the extendible members. Other materials might also be substituted while attaining all of the advantages of this invention. Specific light placements and shapes have been shown. Other light placements and shapes could also be substituted. It will be apparent that many modifications can be made to the disclosed apparatus without departing from the invention. Therefore, it is the intent of the appended claims to cover all such variations and modifications as come within the true spirit and scope of this invention.

What is claimed is:

1. An extendible gate for attachment to a base unit mounted adjacent a traffic path to block traffic flow along the traffic path, said gate comprising:

A) a first hollow member affixed to the base for limited rotation between open and blocking positions, B) a second member, C) support means in said first hollow member for supporting said second member for longitudinal movement along an extension axis with minimal sliding friction, and D) a stop member internally of said first hollow member defining the limits of the displacement distance whereby in the open position said second member nests in said first hollow member and in the blocking position the extension axis slopes downwardly from the base unit thereby causing said second member to extend from said first hollow member at least almost entirely by the force of gravity to a position determined by said stop member thereby to block traffic flow along the traffic pathway, said second member returning to it nested position at least almost entirely by the force of gravity as the extension axis acquires an upward slope from the base unit.

2. An extendible gate as recited in claim 1 wherein said support means includes a plurality of axially spaced bearing means for minimizing sliding friction between said first and second members.

3. An extendible gate as recited in claim 2 wherein said support means forms an inclined ramp with a maximum thickness proximate the base unit and a plurality of axially spaced bearings for rotation about bearing axes that are perpendicular to the extension axis, said second member extending longitudinally from said first hollow member when said first hollow member is in a substantially horizontal position.

4. An extendible gate as recited in claim 2 wherein said support means comprises a plurality of axially spaced bearing sets mounted to said first member for circumscribing said second member, each bearing set having a plurality of angularly spaced bearings that rotate about bearing axes that are perpendicular to the extension axis, said second member extending when said first member inclines downward from the base unit.

5. An extendible gate as recited in claim 1 wherein said stop member includes a first stop element affixed to the interior portion of said first member and a second stop element affixed an outer portion of said second member.

6. An extendible gate as recited in claim 1 additionally comprising a second stop member in the first member proximate the base unit thereby to limit the motion of the second member when said first member moves to the open position.

7. An extendible gate as recited in claim 1 wherein the base unit includes a source of electrical power, said first member additionally comprising an electrical heater and thermostat that prevent the formation of ice within the extendible gate.

8. An extendible gate as recited in claim 1 wherein said second member includes visual annunciators spaced along the length thereof.

9. An extendible gate as recited in claim 8 wherein the base includes a source of electrical power and said visual annunciators include electric lights embedded in said second member.

10. An extendible gate as recited in claim 9 additionally comprising a plurality of electric lights on the exterior of said first member.

11. An extendible gate as recited in claim 1 additionally comprising an end structure on the end of second member that is remote from the base unit, said end structure including a rotatable foot the engages the ground at the traffic path when said extendible gate is in the blocking position.

12. An extendible gate as recited in claim 1 wherein each of said first and second members are extruded structures.

13. A railroad crossing gate for blocking a highway comprising:

A) a base unit mounted in the ground adjacent the highway and having a source of electrical power, a rotatable arm and an electrically operated motor for rotating said arm between an open position and a blocking position, and B) a gate including:

i) a hollow member having a first end affixed to said rotatable arm whereby said hollow member rotates between the open and blocking positions with said arm, ii) an extendible member slidably mounted in the first hollow member to be slidable from an inner position to an outer position relative to said hollow member along an extension axis with minimal sliding friction, and iii) a stop that defines the outer position of said extendible member whereby in the open position said extendible member nests in said hollow member and in the blocking position the extension axis slopes downwardly from the base unit thereby causing said extendible member to extend from said hollow member at least almost entirely by the force of gravity to the outer position thereby to block traffic on the highway from the railroad crossing.

14. A railroad crossing gate as recited in claim 13 wherein said hollow member includes a support structure for said extendible member and said support structure includes a plurality of axially spaced bearing means for minimizing sliding friction between said hollow and extendible members.

15. A railroad crossing gate as recited in claim 14 wherein said support structure forms an inclined ramp with a maximum thickness proximate said arm and a plurality of axially spaced bearings for rotation about bearing axes that are perpendicular to the extension axis.

16. A railroad crossing gate as recited in claim 14 wherein said support structure comprises a plurality of axially spaced bearing sets mounted to said hollow member for circumscribing said extendible member, each bearing set having a plurality of angularly spaced bearings that rotate about bearing axes that are perpendicular to the extension axis.

17. A railroad crossing gate as recited in claim 13 wherein said stop member includes a first stop element affixed to the interior portion of said hollow member and a second stop element affixes to an outer portion of said extendible member.

18. A railroad crossing gate as recited in claim 13 additionally comprising a second stop member in said hollow member proximate said arm thereby to limit the motion of said extendible member when the gate moves to the open position.

19. A railroad crossing gate as recited in claim 13 additionally comprising a heater and thermostat that prevent the formation of ice within said hollow member.

20. A railroad crossing gate as recited in claim 13 wherein said extendible member includes visual annunciators spaced along the length thereof.

21. A railroad crossing gate as recited in claim 13 wherein said visual annunciators include electric lights embedded in said extendible member.

22. A railroad crossing gate as recited in claim 21 additionally comprising a plurality of electric lights on the exterior of said hollow member.

23. A railroad crossing gate as recited in claim 13 additionally comprising an end structure on the end of said extendible member that is remote from said arm, said end structure including a rotatable foot the engages the ground at said traffic path when said extendible gate is in the blocking position.

24. A railroad crossing gate as recited in claim 13 wherein each of said first and second members are formed as extruded structures.

* * * * *